US011667010B2

(12) United States Patent
Eisenblaetter

(10) Patent No.: US 11,667,010 B2
(45) Date of Patent: Jun. 6, 2023

(54) ABRASIVE FLAP DISC

(71) Applicant: PPR GMBH, Koenigsdorf (DE)

(72) Inventor: Gerd Eisenblaetter, Geretsried (DE)

(73) Assignee: PPM GMBH, Koenigsdorf (DE)

( * ) Notice: Subject to any disclaimer, the term of this patent is extended or adjusted under 35 U.S.C. 154(b) by 849 days.

(21) Appl. No.: 16/598,507

(22) Filed: Oct. 10, 2019

(65) Prior Publication Data

US 2020/0180114 A1 Jun. 11, 2020

Related U.S. Application Data

(63) Continuation of application No. 14/028,708, filed on Sep. 17, 2013, now abandoned.

(30) Foreign Application Priority Data

Sep. 18, 2012 (DE) ..... 10 2012 018 435.2
Oct. 29, 2012 (DE) ..... 10 2012 021 267.4

(51) Int. Cl.
*B24D 13/16* (2006.01)
*B24D 11/00* (2006.01)
*B24D 3/28* (2006.01)

(52) U.S. Cl.
CPC ..... *B24D 13/16* (2013.01); *B24D 3/28* (2013.01); *B24D 11/00* (2013.01)

(58) Field of Classification Search
None
See application file for complete search history.

(56) References Cited

U.S. PATENT DOCUMENTS 3,181,939 A 5/1965 Marshall et al.
3,867,795 A * 2/1975 Howard ..... C09K 3/1409 451/544
4,718,204 A * 1/1988 Eisenblatter ..... B24D 13/16 451/496
5,752,876 A 5/1998 Hettes
(Continued)

FOREIGN PATENT DOCUMENTS

CA 960874 1/1975
CA 2354268 6/2000
(Continued)

OTHER PUBLICATIONS

Article "Handbook for Synthetic Materials", vol. 10, Thermosetting Plastics, p. 9911 and p. 917 (Becker/Braun, Kunststoff-Handbuch, Band 10, Duroplaste, S. 911 und S. 917) describing binding agents for grinding tools on a support, 1988 (3 pages).
(Continued)

*Primary Examiner* — Pegah Parvini
*Assistant Examiner* — Ross J Christie
(74) *Attorney, Agent, or Firm* — Grossman, Tucker, Perreault & Pfleger, PLLC

(57) ABSTRACT

An abrasive flap disc having improved properties with respect to production and grinding behavior combines an abrasive grit having a special grit mixture having 25% to 75% (high-performance ceramic) zirconium dioxide and of 25% to 75% aluminum oxide and a number of abrasive lamellae per abrasive flap disc in the range between 30 and 46.

19 Claims, 1 Drawing Sheet

(56) References Cited

U.S. PATENT DOCUMENTS

| | | | | |
|---|---|---|---|---|
| 6,582,289 | B1 * | 6/2003 | Eisenberg | B24D 13/16 451/529 |
| 6,808,446 | B1 | 10/2004 | Mosier | |
| 7,727,056 | B2 | 6/2010 | Gilles | |
| 2005/0137078 | A1 | 6/2005 | Anderson et al. | |
| 2006/0160480 | A1 | 7/2006 | Keuler | |
| 2011/0092137 | A1 | 4/2011 | Ohishi et al. | |

FOREIGN PATENT DOCUMENTS

| | | | |
|---|---|---|---|
| DE | 2259662 | 6/1973 | |
| DE | 8520750 | 8/1987 | |
| DE | 29910931 | 8/1999 | |
| DE | 19853550 | 3/2000 | |
| DE | 202004005538 | 8/2004 | |
| DE | 69917490 | 6/2005 | |
| DE | 102006043989 | 3/2008 | |
| DE | 102008025554 | 12/2008 | |
| DE | 202009007564 | 10/2010 | |
| DE | 102010019242 | 11/2011 | |
| EP | 1142673 | 10/2001 | |
| FR | 2832088 | 5/2003 | |
| GB | 976248 | 11/1964 | |
| GB | 1233997 | 6/1971 | |
| GB | 1392618 | 4/1975 | |
| WO | 0030809 | 6/2000 | |
| WO | 2005087436 | 9/2005 | |
| WO | WO-2008034517 A1 * | 3/2008 | B24D 13/14 |

OTHER PUBLICATIONS

3M Safety Specification Sheet for the grinding tool 747D (3M Sicherheitsdatenblatt schleitwerkzeug), Nov. 11, 2008 (8 pages).

Römpp Chemistry Lexicon, 9th Edition, pp. 5156-5157 (Römpp Chemie Lixikon, Auflage 9, S. 5156-5157), 1995, entry for zirconium chloride (4 pages).

Specification Sheet ALODUR ZK 40 (Datenblatt ALODUR ZK 40), Sep. 2001, pertaining to competitor grinding tool (1 page).

FEPA Safety Specification Sheet (FEPA Sicherheitsdatenblatt Aluminiumoxyd), 2002, relates to the tool mentioned in the Sep. 21, 2001 Specification Sheet ALODUR ZK 40 (1 page).

Saint-Gobain Specification Sheet NZPlus (Saint-Gobain Datenblatt NZPlus) dated Nov. 3, 2006, pertaining to competitor grinding materials (NZPlus), (2 pages).

Klingspor Price List 2011 (Klingspor Preiliste 2011), competitor price list from 2011 with some product specifications (8 pages).

* cited by examiner

Fig. 1
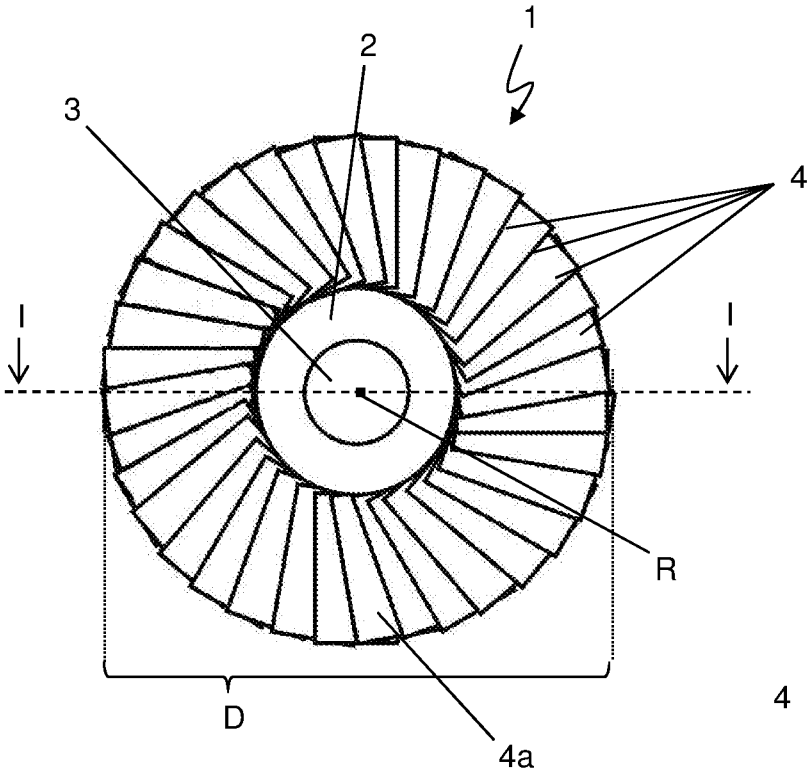
Fig. 3
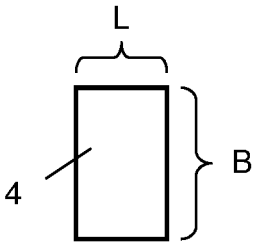
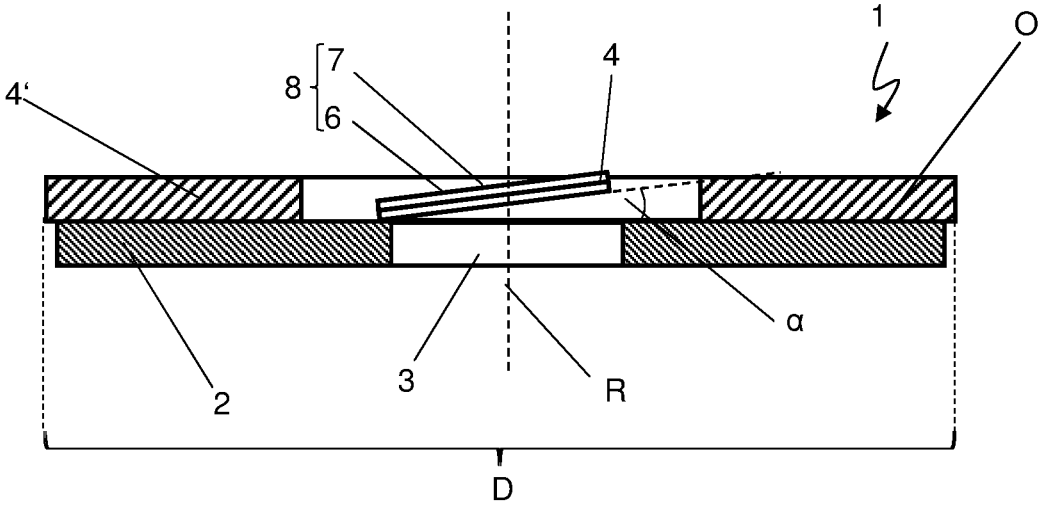
Fig. 2

ABRASIVE FLAP DISC

CROSS REFERENCE TO RELATED APPLICATIONS

This application is a continuation of U.S. non-provisional application Ser. No. 14/028,708 filed Sep. 17, 2013, which claims priority under 35 U.S.C. § 119 to German application serial no. 10 2012 018 435.2 filed Sep. 18, 2012 and German application serial no. 10 2012 021 267.4 filed Oct. 29, 2012, the disclosures of which are incorporated by reference.

FIELD

The invention relates to an abrasive flap disc having a carrier plate and abrasive lamellae, which are attached in a fan shape around a central opening, made of abrasive fabric, comprising a base fabric and abrasive grit applied to the base fabric.

BACKGROUND

Abrasive flap discs according to the species are known from the prior art and are described, for example, in DE 85 20 750 U1, DE 299 10 931 U1, and DE 20 2004 005 538 U1, to which reference is hereby made with respect to the construction and the use of abrasive flap discs according to the species. The essential elements of such an abrasive flap disc are a carrier plate and abrasive lamellae, which are attached on the carrier plate around a central opening in the carrier plate and overlapping one another. The attachment of the abrasive flap disc to a suitable drive machine occurs via the central opening within the carrier plate. The conventionally rectangular, for example, square abrasive lamellae consist of an abrasive fabric, which has an abrasive grit carried by a base fabric. The abrasive grit frequently comprises so-called oxide ceramics, for example, the high-performance ceramics zirconium dioxide ($ZrO_2$) and aluminum oxide ($Al_2O_3$), in particular in the form of the rhombohedral modification ($\alpha$-$Al_2O_3$; corundum).

In grinding operation, the previously known abrasive flap discs wear out comparatively rapidly with increasing usage duration, so that a worn abrasive flap disc must frequently be replaced by an unused abrasive flap disc, whereby high costs result for the user. In order to achieve a satisfactory usage duration, equipping the carrier plate with a comparatively high number of grinding lamellae per abrasive flap disc is typical in the prior art. This is disadvantageous, however, in that the production and purchasing costs of an abrasive flap disc thus rise significantly. In addition, the full grinding potential of such an abrasive flap disc frequently cannot be completely exploited.

SUMMARY

The object of the invention is to specify an abrasive flap disc, which allows optimum utilization of the grinding potential of an abrasive flap disc and which has lower production costs simultaneously.

An essential basic idea of the invention is that an optimum compromise between cost-effectiveness in the production of the abrasive flap disc and maximum utilization of the grinding potential of an abrasive flap disc is only achieved by a specific number of grinding lamellae of the abrasive flap disc with simultaneous use of a special abrasive grit. According to the invention, it is provided that the abrasive grit is a grit mixture which consists of 25% to 75% zirconium dioxide ($ZrO_2$) and of 25% to 75% aluminum oxide ($Al_2O_3$). The grit mixture therefore exclusively consists of these two components, which, when mixed together in the predefined ratio, supplement one another to form 100% of the grit mixture used. The percentage specifications specified in the present case describe proportion ratios with respect to mass per volume or volume per volume, but very particularly with respect to mass per mass. The range specifications used respectively indicate inclusive specifications, i.e., the specified range limits are expressly also comprised by the invention. This applies not only for the range specifications used in this paragraph, but rather relates to the entire description of the invention.

A further essential aspect of the invention is that contrary to the strategy previously known in the prior art for improving the performance of abrasive flap discs according to the species, a reduced number of abrasive lamellae per abrasive flap disc is optimum in addition to the use of the special grit mixture. Specifically, it is therefore provided according to the invention that the carrier plate is equipped with a total of 30 to 46 abrasive lamellae per abrasive flap disc. Due to the lower number of abrasive lamellae, they can be arranged at a substantially smaller angle of attack in relation to the support surface of the carrier plate, whereby outstanding grinding results are made possible. Optimum utilization of the grinding potential of the abrasive flap disc is only achieved in this specific numeric range of abrasive lamellae per carrier plate according to the invention in conjunction with the above-specified specific composition of the two-component grit mixture.

Overall, the present invention is thereby distinguished by the special interaction between the defined composition of the employed two-component grit mixture and the number of abrasive lamellae having this grit mixture per carrier plate. The targeted formation of an abrasive flap disc in consideration of only these two factors "number of the abrasive lamellae" and "ratio of the two abrasive grit components zirconium dioxide and aluminum dioxide" according to the above statements result in abrasive flap discs having outstanding properties with respect to service life, grinding result, and cost-effectiveness.

Ideally, the grit mixture of the abrasive grit consists of 50% to 75% and in particular 70% to 75% zirconium dioxide and of 25% to 50% and in particular 25% to 30% aluminum oxide. These proportion ratios of the two abrasive grit components have proven to be particularly suitable.

Further possible variations result with respect to the employed grain sizes of the abrasive grit. The grit mixture provided according to the invention unfolds its full abrasive potential at grain sizes of 40, 50, or 60, in particular 50, according to CAMI (Coated Abrasive Manufacturing Institute) grain size specification. These grain size specifications designate at 40 a grit mixture having an average particle diameter of 425 μm, at 50 a grit mixture having an average particle diameter of 348 μm, and at 60 grit mixture having an average particle diameter of 265 μm.

Equipping the carrier plate with 34 to 44 abrasive lamellae is also preferable with respect to the overall performance of an abrasive flap disc according to the invention. In a preferred embodiment the number of abrasive lamellae per abrasive flap disc is 44.

The optimum angle of attack of the individual abrasive lamellae in relation to the external surface of the carrier plate is in the range between 3° and 13°, in particular in the range from 9° to 12°. This comparatively flat angle of attack of the surface plane of the grinding lamellae in relation to the support surface of the carrier plate provides optimum usage results of the grinding potential of the abrasive lamellae of an abrasive flap disc. Ideally, all abrasive lamellae of an abrasive flap disc are arranged at the same angle of attack on the carrier plate and are offset in relation to the respective neighboring abrasive lamellae in each case by the same angular amount relative to the axis of rotation of the abrasive flap disc.

The abrasive fabric typically comprises a base fabric, to which the grit mixture is applied. The base fabric is therefore used as a support means for the grit mixture. The base fabric preferably consists of polyester or of a mixture of polyester and cotton.

In addition to the base fabric and the grit mixture, the abrasive fabric can have further additives, for example, for bonding the abrasive grit to the base fabric and/or for modifying the abrasive properties of the abrasive flap disc. It has proven to be advantageous here if the abrasive fabric contains calcium carbonate ($CaCO_3$) as a filler. Additionally or alternatively, the abrasive fabric ideally has phenol resin as a binder.

The proportions of the components present in the abrasive fabric, for example, the base fabric, the grit mixture, the filler(s), and/or the binder(s), can vary in a broad spectrum. However, to obtain optimum grinding results and longer usage intervals it has proven to be advantageous if the proportion of the two components of the grit mixture is in specific ranges with respect to the overall abrasive fabric. Ideally, the proportion of the grit mixture per se is 25% to 70% of the total mass of the abrasive fabric. Specifically, the mass proportion of zirconium dioxide in the abrasive fabric is 20% to 50%, in particular 25% to 35%, and very particularly 30% to 32%, and the mass proportion of aluminum oxide in the abrasive fabric is 6% to 20%, in particular 6% to 15%, and very particularly 7% to 10%.

The advantages according to the invention can fundamentally be achieved with abrasive flap discs over the entire size spectrum of abrasive flap discs used. However, it has particularly proven itself if the diameter of the abrasive flap disc according to the above embodiments is in the range between 110 mm and 130 mm, preferably 115 mm or 125 mm. The diameter of the abrasive flap disc is the edge distance of two points lying on the edge of the abrasive flap disc, whose connecting straight line extends through the axis of rotation of the abrasive flap disc.

The individual abrasive lamellae are ideally between 24 mm and 30 mm wide and preferably between 24 mm and 25 mm wide at a disc diameter of 115 mm and preferably 27 mm to 30 mm wide at a disc diameter of 125 mm. The individual abrasive lamellae are also additionally or alternatively preferably 19 mm to 26 mm long. Abrasive lamellae having identical dimensions are preferably used for an abrasive flap disc.

BRIEF DESCRIPTION OF THE DRAWINGS

The invention will be explained in greater detail hereafter on the basis of an exemplary embodiment indicated in the figures. In the schematic figures FIG. 1 shows a top view of the front side or grinding side, respectively, of an abrasive flap disc;

FIG. 2 shows a lateral sectional view along line I-I from FIG. 1; and

FIG. 3 shows an individual abrasive lamellae in a top view.

DETAILED DESCRIPTION

Essential elements of the abrasive flap disc 1 are a carrier plate 2 in the form of a circular disk having a central opening 3 and abrasive lamellae 4 arranged on the grinding side of the abrasive flap disc 1 on the outer side of the carrier plate 2. Each abrasive lamellae 4 has a rectangular shape. One surface of the abrasive lamellae is provided with abrasive grid. The other surface is connected to the carrier plate 2, for example, via glued bonds, overlapping one another in the form of a fan and circularly around the passage opening 3 peripherally to the outer edge of the carrier plate 2. The arrangement of rectangular abrasive lamellae 4 leads to a good overlapping at the outer circumference of the abrasive flap disc 1 and little overlapping at the inner area of the abrasive flap disc 1. The abrasive flap disc has an outer diameter D of 125 mm.

The abrasive flap disc 1 can also have indentations for accommodating a fastening nut, in particular in the region of the central opening 3, fastening means, for example, a thread or other such features which are used in such a abrasive flap discs in the prior art and go beyond the basic structure indicated in FIG. 1. The central opening 3 is designed receive a driving shaft of a driving machine and a fastening disc on the driving shaft (not shown).

Furthermore, further details on the construction of the abrasive flap disc result from the lateral sectional view according to FIG. 2. FIG. 2 is a cross-sectional view along line I-I from FIG. 1. The individual abrasive lamellae 4 consist of an abrasive fabric 8, comprising a base fabric 6 and abrasive grit 7 applied to the base fabric 6, which is shown as a layer for reasons of clarity in FIG. 2 and specifically comprises manifold abrasive grains, in the present exemplary embodiment having an average particle size of 348 μm (grain size 50 according to CAMI). The abrasive lamellae 4 are arranged overlapping one another around the center point of the passage opening 3. In FIG. 2, the entirety of the abrasive lamellae 4 are shown as the abrasive lamellae layer 4' and the individual abrasive lamella **4*a* from FIG. 1 is indicated in this layer as an example. The flat abrasive lamellae 4 are arranged inclined at an angle of attack α in relation to the circular outer surface or support surface(s) of the carrier plate 2. The support surface O is a support surface on the carrier plate 2 extending substantially transversely to the axis of rotation R of the abrasive flap disc 1. The total of 36 abrasive lamellae 4 are implemented uniformly and are each arranged at an angular interval of 10° to one another uniformly distributed around the axis of rotation R of the abrasive flap disc 1**.

The abrasive fabric 8 comprises, in addition to a grit mixture, consisting of a mixture of zirconium oxide and aluminum oxide, further components, for example, calcium carbonate as a filler and phenol resin as a binder. In the concrete exemplary embodiment, the grit mixture of the abrasive grit consists of 70% zirconium oxide and 30% aluminum oxide, in relation to the mass proportions of the two components to the total mass of the grit mixture. With respect to the total mass of the abrasive fabric 8, the mass proportions and percentage mass/mass are zirconium oxide 30% and aluminum oxide 13%. The further mass proportions of the abrasive fabric 8 originate, inter alia, from the base fabric 6 consisting of polyester and further components contained in the abrasive fabric 8, for example, the filler calcium carbonate and the binder phenol resin.

Furthermore, a single abrasive lamella 4 of the abrasive lamellae from FIGS. 1 and 2 is shown in a top view in FIG. 3. This individual abrasive lamella 4 has a width B of 28 mm and a length L of 20 mm.

What is claimed is:

1. An abrasive flap disc comprising:

a carrier plate and abrasive lamellae which are arranged on the carrier plate around a central opening, and are made of an abrasive fabric comprising a base fabric and abrasive grit applied to the base fabric, a diameter of the abrasive flap disc being in a range of between 110 mm and 130 mm and the abrasive lamellae having a rectangular shape, wherein the abrasive grit is a grit mixture, wherein the grit mixture of the abrasive grit comprises 70% to 75% zirconium dioxide and of 25% to 30% aluminum oxide based on a total amount of the grit mixture, the number of the abrasive lamellae is between 30 and 46, and the abrasive lamellae have a width in a range between 24 mm and 30 mm.

2. The abrasive flap disc according to claim 1, wherein the number of the abrasive lamellae is between 34 and 44.

3. The abrasive flap disc according to claim 1, wherein the number of the abrasive lamellae is 44.

4. The abrasive flap disc according to claim 1, wherein the base fabric comprises polyester.

5. The abrasive flap disc according to claim 1, wherein the abrasive fabric has at least one from the group consisting of calcium carbonate as a filler and phenol resin as a binder.

6. The abrasive flap disc according to claim 1, wherein the abrasive lamellae are arranged at an angle ($\alpha$) in a range between 3° and 13° to a support surface of the carrier plate.

7. The abrasive flap disc according to claim 1, wherein the abrasive lamellae are arranged at an angle ($\alpha$) in a range between 9° and 12° to a support surface of the carrier plate.

8. The abrasive flap disc according to claim 1, wherein the diameter of the abrasive flap disk is 115 mm.

9. The abrasive flap disc according to claim 1, wherein the diameter of the abrasive flap disc is 125 mm.

10. The abrasive flap disc according to claim 1, wherein the abrasive lamellae have a length in a range between 19 mm and 26 mm.

11. The abrasive flap disc according to claim 1, wherein the grit mixture is 25% to 70% of a total mass of the abrasive fabric.

12. The abrasive flap disc according to claim 1, wherein a mass proportion of the zirconium dioxide in the abrasive fabric is 20% to 50% of a total mass of the abrasive fabric.

13. The abrasive flap disc according to claim 1, wherein a mass proportion of the zirconium dioxide in the abrasive fabric is 25% to 35% of a total mass of the abrasive fabric.

14. The abrasive flap disc according to claim 1, wherein a mass proportion of the zirconium dioxide in the abrasive fabric is 30% to 32% of a total mass of the abrasive fabric.

15. The abrasive flap disc according to claim 1, wherein a mass proportion of the aluminum oxide in the abrasive fabric is 6% to 20% of a total mass of the abrasive fabric.

16. The abrasive flap disc according to claim 1, wherein a mass proportion of the aluminum oxide in the abrasive fabric is 6% to 15% of a total mass of the abrasive fabric.

17. The abrasive flap disc according to claim 1, wherein a mass proportion of the aluminum oxide in the abrasive fabric is 7% to 10% of a total mass of the abrasive fabric.

18. The abrasive flap disc according to claim 1, wherein the grit mixture comprises grains having an average grain diameter of 425 μm, 348 μm or 265 μm.

19. The abrasive flap disc according to claim 1, wherein the base fabric comprises a mixture of polyester and cotton.

* * * * *